US008550055B2

(12) United States Patent
Ferch et al.

(10) Patent No.: US 8,550,055 B2
(45) Date of Patent: Oct. 8, 2013

(54) FUEL MANAGEMENT SYSTEMS AND METHODS FOR VARIABLE DISPLACEMENT ENGINES

(75) Inventors: Eric B. Ferch, Northville, MI (US); Anthony L. Marks, Novi, MI (US); Ryan Bruss, White Lake, MI (US); Ronald M. Wozniak, Auburn Hills, MI (US); Eloy Martinez, Toluca (MX); Jon C Wasberg, Davison, MI (US)

(73) Assignee: GM Global Technology Operations LLC

( * ) Notice: Subject to any disclaimer, the term of this patent is extended or adjusted under 35 U.S.C. 154(b) by 716 days.

(21) Appl. No.: 12/721,105

(22) Filed: Mar. 10, 2010

(65) Prior Publication Data

US 2011/0220068 A1 Sep. 15, 2011

(51) Int. Cl.
*F02D 41/30* (2006.01)

(52) U.S. Cl.
USPC ..... 123/481; 123/198 DB; 123/198 DC

(58) Field of Classification Search
USPC ..... 123/479–481, 445, 198 F, 198 DC, 123/198 DB; 73/114.58, 114.62
See application file for complete search history.

(56) References Cited

U.S. PATENT DOCUMENTS

| | | | | |
|---|---|---|---|---|
| 5,377,631 | A * | 1/1995 | Schechter | 123/198 F |
| 6,360,724 | B1 * | 3/2002 | Suhre et al. | 123/481 |
| 6,435,147 | B1 * | 8/2002 | Eichenseher et al. | 123/90.11 |
| 7,322,342 | B2 * | 1/2008 | Maemura et al. | 123/491 |
| 2002/0053332 | A1 * | 5/2002 | Chamberlin et al. | 123/196 R |
| 2003/0172900 | A1 * | 9/2003 | Boyer et al. | 123/198 F |
| 2005/0131618 | A1 * | 6/2005 | Megli et al. | 701/101 |
| 2005/0193987 | A1 * | 9/2005 | Doering | 123/479 |
| 2006/0005811 | A1 * | 1/2006 | Hartmann | 123/406.47 |
| 2007/0131196 | A1 * | 6/2007 | Gibson et al. | 123/198 F |
| 2007/0199533 | A1 * | 8/2007 | Takahashi | 123/179.4 |
| 2007/0277776 | A1 * | 12/2007 | Thomas | 123/299 |
| 2009/0133662 | A1 * | 5/2009 | Hartmann et al. | 123/198 DC |
| 2009/0271095 | A1 * | 10/2009 | Kojima | 701/113 |

OTHER PUBLICATIONS

U.S. Appl. No. 12/326,404, filed Dec. 2, 2008, Whitney et al.
U.S. Appl. No. 12/392,411, filed Feb. 25, 2009, Aldrich, III et al.
U.S. Appl. No. 12/535,950, filed Aug. 5, 2009, Whitney et al.
U.S. Appl. No. 12/605,720, filed Oct. 26, 2009, Riegel et al.

* cited by examiner

*Primary Examiner* — John Kwon
*Assistant Examiner* — Johnny Hoang

(57) ABSTRACT

A control system includes an engine mode transition module that initiates a deactivated mode to deactivate at least one cylinder. A scheduling module schedules a command to disable a spark plug at least one engine cycle after a command to disable a fuel injector for the at least one cylinder.

18 Claims, 5 Drawing Sheets

FUEL MANAGEMENT SYSTEMS AND METHODS FOR VARIABLE DISPLACEMENT ENGINES

FIELD

The present disclosure relates to ignition and fuel control systems, and more particularly to spark control during active fuel management.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Active Fuel Management™ or variable displacement allows displacement of an internal combustion engine to change by deactivating one or more cylinders. Deactivating cylinder(s) improves fuel economy. During light-load conditions, a deactivated mode may be initiated to deactivate one or more of the cylinders. The deactivated cylinders may be reactivated during heavy-load conditions.

During the deactivated mode, fuel is not provided to the deactivated cylinders and intake and exhaust valves of the deactivated cylinders are maintained in a closed state. Air and fuel are prevented from entering the combustion chambers of the deactivated cylinders. Contents of the combustion chambers are prevented from exiting the deactivated cylinders. The deactivated cylinders perform as air shocks during the deactivated mode.

SUMMARY

A control system includes an engine mode transition module that initiates a deactivated mode to deactivate at least one cylinder. A scheduling module schedules a command to disable a spark plug at least one engine cycle after a command to disable a fuel injector for the at least one cylinder.

Further areas of applicability of the present disclosure will become apparent from the detailed description provided hereinafter. It should be understood that the detailed description and specific examples, while indicating the preferred embodiment of the disclosure, are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
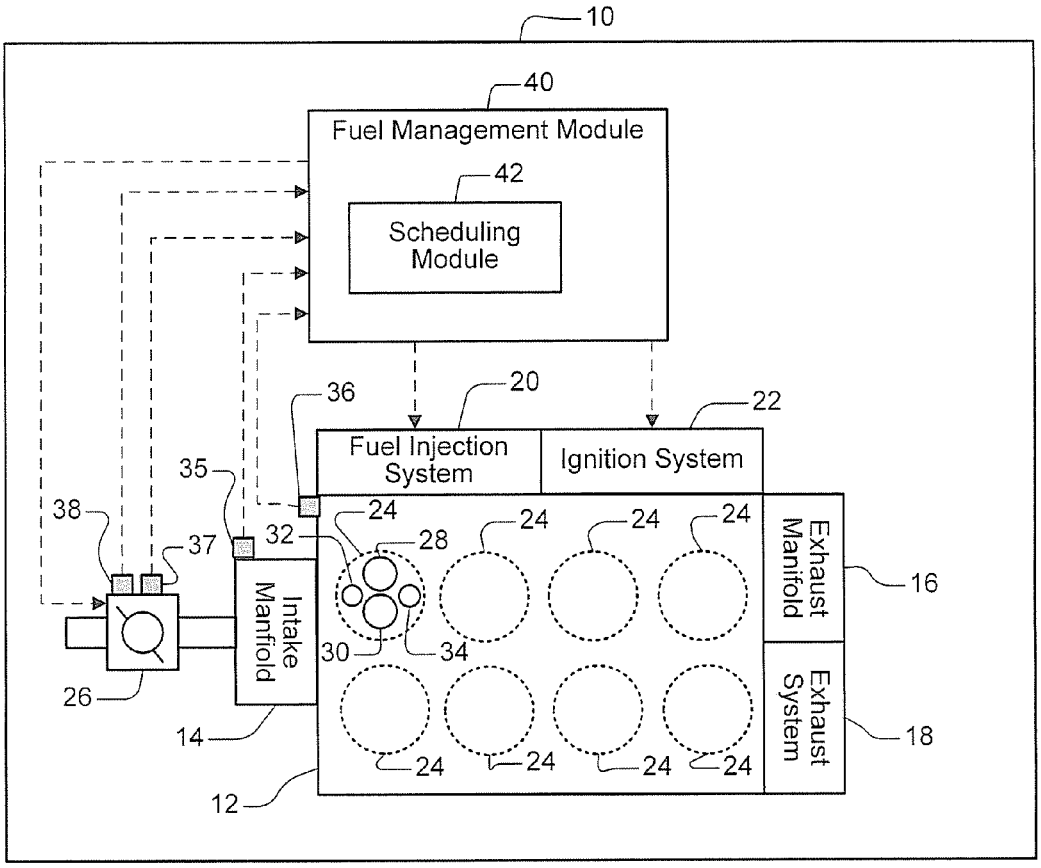
FIG. 1 is a functional block diagram of an exemplary engine system that includes a fuel management module according to the present disclosure.

The following description is merely exemplary in nature and is in no way intended to limit the disclosure, its application, or uses. For purposes of clarity, the same reference numbers will be used in the drawings to identify similar elements. As used herein, the term "module" refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

Exhaust valves of deactivated cylinders do not open during a deactivated mode. Therefore, oil may accumulate on the cylinder walls in the combustion chambers. The oil may form a mist in the combustion chambers and accumulate, for example, between electrodes of spark plugs over multiple engine cycles. Typically, the spark plugs are enabled in the deactivated cylinders. Since oil performs as an insulator, spark that is created by a spark plug may jump between a first electrode (e.g., side electrode) and an insulator (e.g., ceramic material) surrounding a second electrode (e.g., center electrode) of the spark plug. As a result, the spark plug may require a voltage that is higher than normally commanded. The higher voltage may exceed design limits of the ceramic insulator and cause holes to form in the ceramic insulator, resulting in abrasive debris in a combustion chamber. The abrasive debris can scratch cylinder walls, cause premature piston ring and cylinder bore wear, and lead to increased oil consumption.

The fuel management system according to the present disclosure initiates a deactivated mode and schedules and issues a command to disable spark plugs relative to a command to disable fuel injectors for deactivated cylinders. Delay in disabling the fuel injectors after the issuance of the command to disable the fuel injectors is taken into account. The spark plugs for the deactivated cylinders are disabled after the fuel injectors for deactivated cylinders are disabled and after fuel from the last fuel injection event is burned. Therefore, spark plug damage due to oil buildup in the deactivated mode is prevented.

Referring to FIG. 1, an engine system 10 includes an engine 12, an intake manifold 14, an exhaust manifold 16, an exhaust system 18, a fuel injection system 20, and an ignition system 22. The engine 12 is a variable displacement engine and includes multiple cylinders 24. While eight cylinders 24 are shown, the engine 12 may include any number of cylinders 24.

Air is drawn into the intake manifold 14 through a throttle 26 and is distributed into the cylinders 24. Each cylinder 24 includes an intake valve 28, an exhaust valve 30, a fuel injector 32, and a spark plug 34. For the sake of clarity, only one intake valve 28, exhaust valve 30, fuel injector 32, and spark plug 34 are illustrated.

The fuel injector 32 injects fuel that is combined with the air as the air is drawn into the cylinder 24. A piston (not shown) compresses the air/fuel mixture within the cylinder 24. The spark plug 34 initiates combustion of the air/fuel mixture, forcing the piston to reciprocate in the cylinder 24. The piston drives a crankshaft (not shown) to produce drive torque. Combustion exhaust within the cylinder 24 is forced out an exhaust port when the exhaust valve 30 is opened. The exhaust is treated in the exhaust system 18 and released to the atmosphere.

The throttle 26 regulates mass air flow into the intake manifold 14 based on, for example, a position of an accelerator pedal (not shown). A plurality of sensors, including but not limited to, mass absolute pressure (MAP) sensor 35, an engine speed sensor 36, a mass air flow (MAF) sensor 37, and a throttle position sensor 38, are provided to monitor engine operating conditions. Signals from the plurality of sensors are sent to a fuel management module 40 that controls operation of the engine 12 based on the engine operating conditions. For example, the fuel management module 40 deactivates some of the cylinders 24 during light engine load and re-activates the deactivated cylinders during heavy engine load. The fuel management module 40 includes a scheduling module 42 that schedules a command to disable/enable the spark plug and a command to disable/enable the fuel injector for the deactivated cylinders 24.

Figure 2:
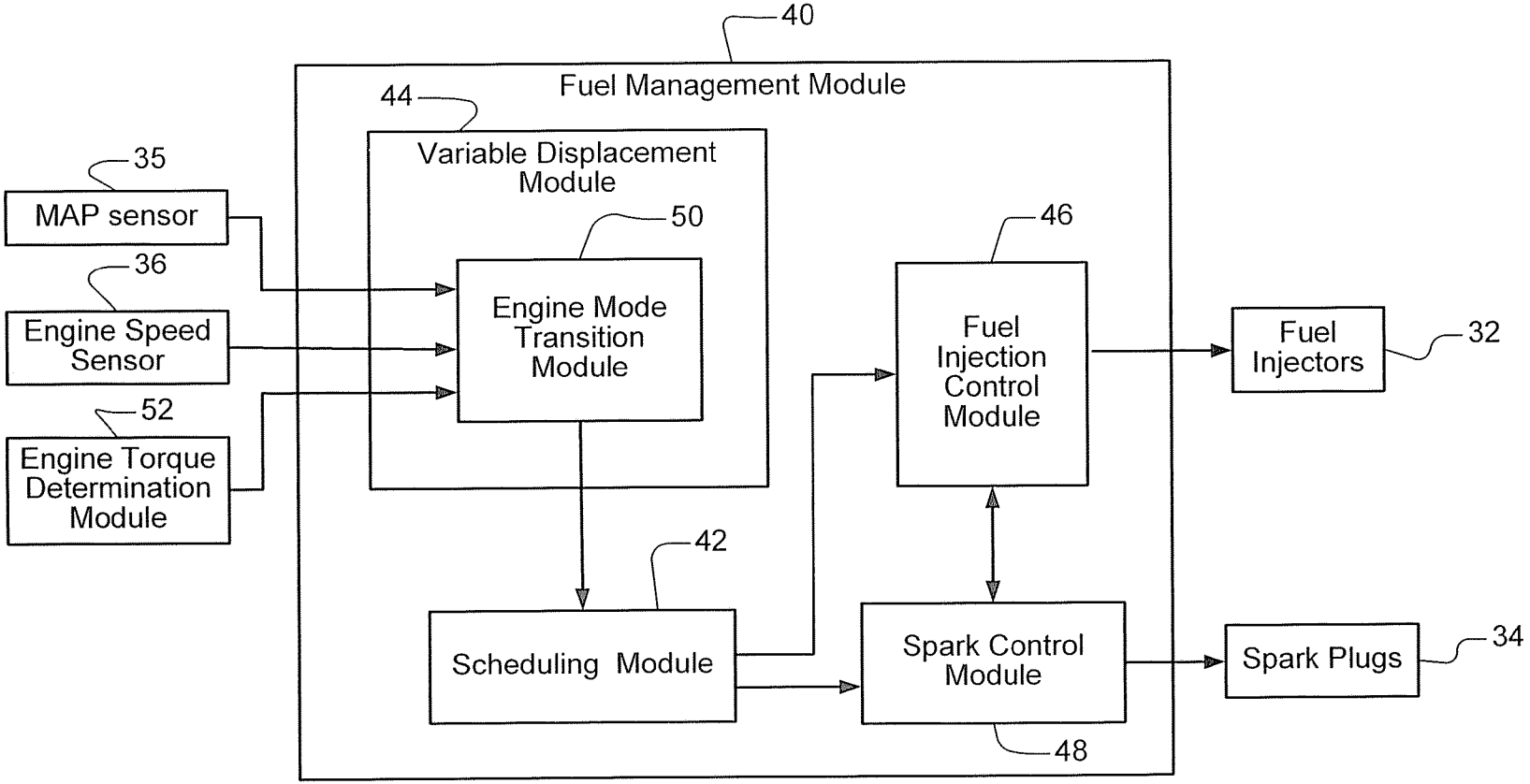
FIG. 2 is a functional block diagram of a fuel management module according to the present disclosure.

Referring to FIG. 2, the fuel management module 40 includes the scheduling module 42, a variable displacement module 44, a fuel injection control module 46, and a spark control module 48. The variable displacement module 44 includes an engine mode transition module 50. The engine mode transition module 50 determines a desired engine mode under the engine operating conditions to achieve optimum fuel efficiency. The engine operating conditions include, but are not limited to, engine speed, engine load, and engine torque, and may be monitored or determined by the MAP sensor 35, the engine speed sensor 36, and an engine torque determination module 52.

For example, the engine 12 may be operated between a full-cylinder mode and a deactivated mode (or a reduced cylinder mode). When high output torque is requested, a full-cylinder mode may be desired and all cylinders 24 are active. When less engine torque is requested and engine is running at light loads and low engine speeds, a deactivated mode may be desired. In the deactivated mode, one or more of the cylinders 24 are deactivated. Cylinders 24 are deactivated, for example only, by disabling fueling to one or more cylinders and by closing the intake and exhaust valves 28 and 30. Generally, half of the cylinders 24 are deactivated in the deactivated mode in a variable displacement system. However, any number of cylinders 24 may be deactivated to meet the engine operating needs.

The fuel injection control module 46 communicates with fuel injectors 32 and controls fuel injection into the cylinders 24 by enabling or disabling the fuel injectors 32. The spark control module 48 communicates with the spark plugs 34 and controls ignition of spark plugs 34 by enabling or disabling the spark plugs 34. The scheduling module 42 communicates with the engine mode transition module 50, the fuel injection control module 46, and the spark control module 48 and schedules a command to disable/enable the spark plugs 34 and a command to disable/enable the fuel injectors 32.

To transition the engine 12 from the full-cylinder mode to the deactivated mode, the engine 12 undergoes four stages: an all-cylinder-active stage, a deactivation-in-progress stage, a deactivation-complete stage, and an activation-in-progress stage. In the all-cylinder-active stage, all cylinders 24 are active. In the deactivation-in-progress stage, selected cylinders 24 are sequentially deactivated by disabling the fuel injectors 32 for the selected cylinders 24. In the deactivation-complete stage, fuel supply to all selected cylinders are stopped and all selected cylinders are deactivated. In the activation-in-progress stage, the fuel injectors 32 for the deactivated cylinders 24 are sequentially enabled to resume fueling to the deactivated cylinders 24.

To ensure that fuel injected into the cylinders 24 that are selected to be deactivated is burned, the spark plugs 34 for the selected cylinders 24 are disabled after all selected cylinders are deactivated. In other words, the spark plugs 34 are disabled when the engine transition is in the deactivation-complete stage. The scheduling module 42 calculates and schedules the command to disable the spark plugs 34 a first predetermined period after the command to disable the fuel injectors 32 taking latencies of the fuel injection system 20 and the ignition system 22 into account.

Figure 3:
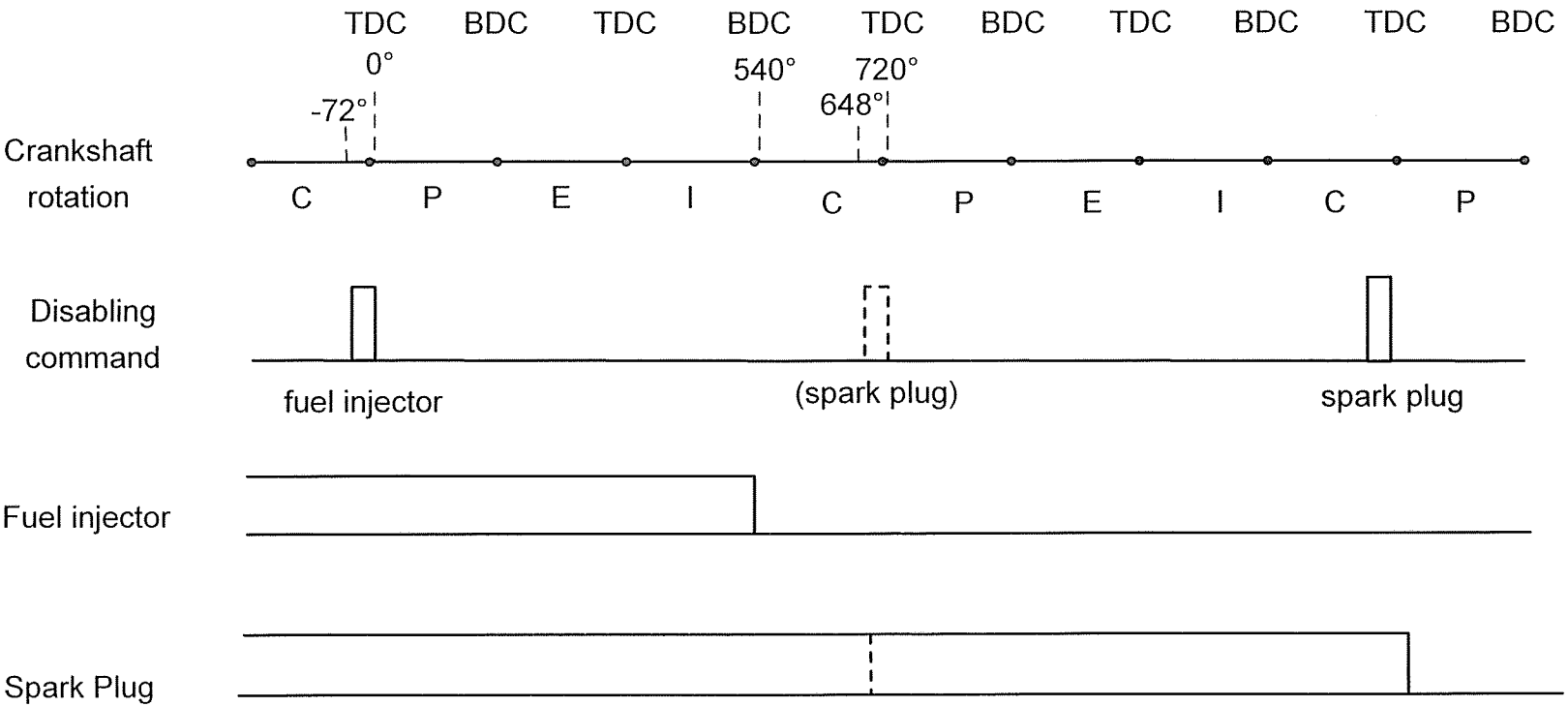
FIG. 3 is a diagram showing a relationship among a crankshaft position, timing of a command to disable a fuel injector and a spark plug, and disabling timing of the fuel injector and the spark plug.

Referring to FIG. 3, the scheduling module 42 schedules the command to disable the fuel injectors 32 for the selected cylinders 24 in the current engine cycle when the engine mode transition module 50 initiates the deactivated mode. The scheduling module 42 may schedule and issue a command to disable the fuel injectors 32 at approximately 72 degrees before the top dead center (TDC) in the compression stroke of the current engine cycle. The fuel injectors 32 may not be disabled in the same engine cycle when the command to disable the fuel injectors 32 is issued. The delay in disabling the fuel injectors 32 is caused by latencies in the fuel injection system 20. It may take approximately 540 crankshaft rotation degrees to actually disable the fuel injectors 32. Therefore, when the command to disable the fuel injectors 32 is scheduled at approximately 72 degrees before the TDC in the compression stroke of the current engine cycle, the fuel injectors 32 are actually disabled in the intake stroke or the compression stroke of the next engine cycle.

The scheduling module 42 schedules the command to disable the spark plugs 34 a first predetermined period after the command to disable the fuel injectors 32. The predetermined first period is at least one engine cycle. For example, the first predetermined period may be set to be equal to at least two engine cycles. Less delay occurs in disabling the spark plugs 34. The spark plugs 34 may be disabled in the same engine cycle when the command to disable the spark plugs 34 is issued.

Fuel injection events generally occur in the intake stroke. The fuel injection timing may vary based on camshaft position, type of fuel used, and fuel temperature. When the fuel injectors 32 are disabled in the intake stroke in the next engine cycle, the fuel injectors 32 may be disabled at a point before or after the normal fuel injection point. When the fuel injectors 32 are disabled before the normal fuel injection point, no fuel is injected in the next engine cycle and the spark plugs 34 can be disabled in the next engine cycle. When the fuel injectors 32 are disabled after the normal fuel injection point, fuel is injected in the next engine cycle and the spark plugs 34 can be disabled two engine cycles later. To ensure that the spark plugs 34 are disabled after the fuel from the last fuel injection event is burned, the command to disable the spark plugs 34 may be issued at least two engine cycles after the command to disable the fuel injectors 32 is issued. Similarly, the command to disable the spark plugs 34 is issued at approximately 72 degrees before the top dead center in the compression stroke. Therefore, despite the varied fuel injection timing caused by the camshaft position, type of fuel used and fuel temperature, the spark plugs 34 are disabled after the fuel from the last fuel injection even is burned. The scheduling module 42 ensures that the spark plugs 34 are disabled after fuel supply to all selected cylinders is stopped.

Figure 4:
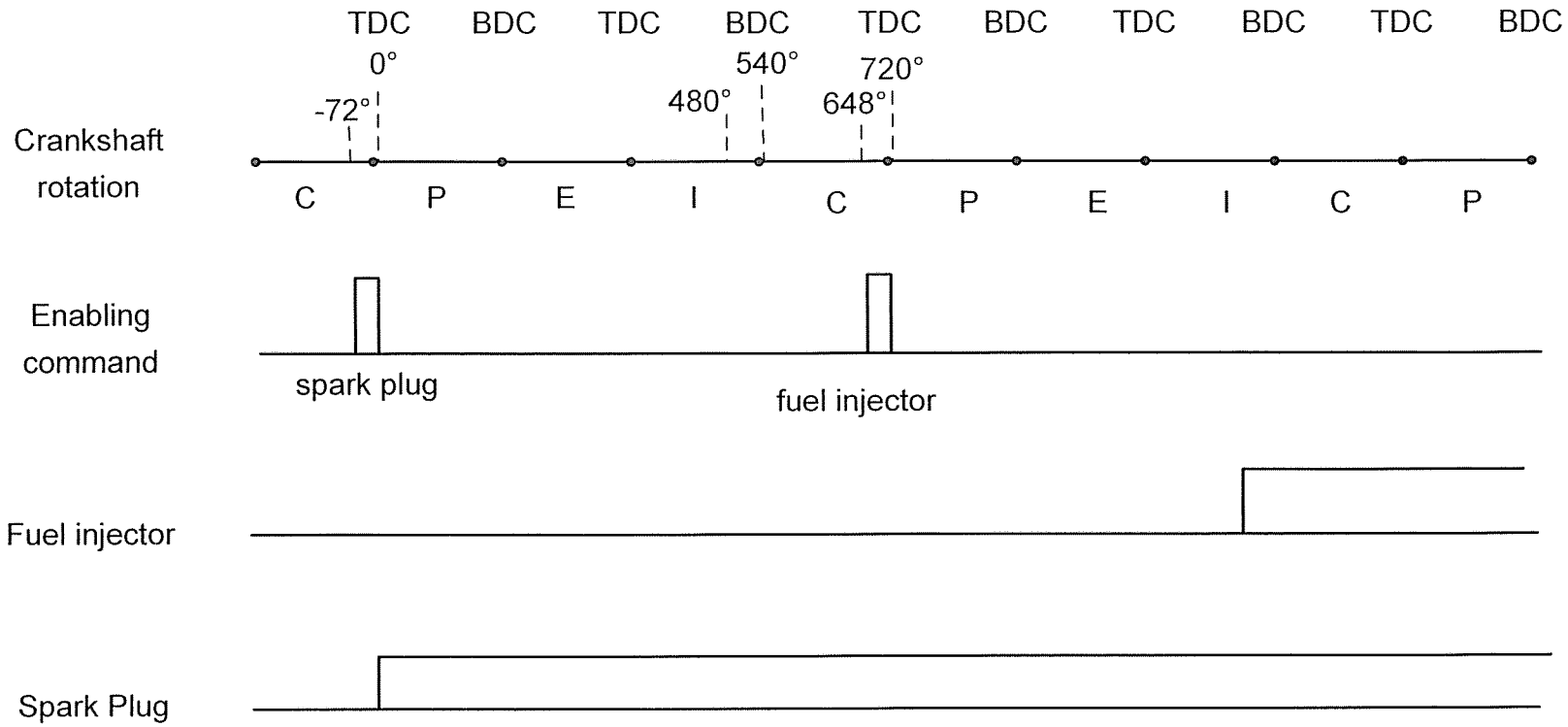
FIG. 4 is a diagram showing a relationship among a crankshaft position, timing of a command to enable a fuel injector and a spark plug, and enabling timing of the fuel injector and the spark plug.

Referring to FIG. 4, when an engine load is increased, the engine mode transition module 50 may determine that a full-cylinder mode is desired. The engine mode transition module 50 initiates a full-cylinder mode and sends an activation command to the scheduling module 42. The scheduling module 42 may schedule and issue a command to enable the spark plugs 34 for the deactivated cylinders in the current engine cycle when the engine mode transition module 50 initiates the full-cylinder mode. The scheduling module 42 may schedule and issue a command to enable the fuel injectors 32 for the deactivated cylinders a second predetermined period (for example, at least one engine cycle) after the command to enable the spark plugs 34 is issued.

For example, the scheduling module 42 may issue a command to enable the spark plugs 34 at approximately 72 crankshaft degrees before the TDC in the compression stroke of the current engine cycle. Depending on when the full-cylinder mode is initiated in the current engine cycle, one or two engine cycles may pass before the spark plugs 34 are enabled. For example, a piston of a deactivated cylinder may have passed a normal spark ignition point when the full-cylinder mode is initiated. Therefore, the spark plug 34 for this cylinder may not be enabled in the current engine cycle, and will be enabled in the compression stroke of the next engine cycle. The spark ignition point is the position of the piston when a spark is ignited in an active cylinder. For example, the spark is ignited when the piston is moved within a threshold range of the top dead center (TDC).

The spark plugs 34 may be enabled in the current engine cycle when the command to disable the spark plugs 34 is issued. In contrast, it generally takes from approximately 480 degrees to approximately 540 degrees after top dead center from the compression stroke of the current engine cycle to enable the fuel injectors 32. Similarly, the command to enable the fuel injectors 32 is scheduled and issued at approximately 72 crankshaft degrees before the top dead center in the compression stroke. By scheduling the command to enable the fuel injectors 32 at least one engine cycle after the command to enable the spark plugs 34, the fuel injectors 32 will be enabled one or two engine cycles after the spark plugs 34 are enabled. Therefore, the scheduled command to enable the spark plugs 34 and the fuel injectors 32 ensures that fuel can be burned when the fuel injectors 32 are enabled.

It is understood and appreciated that a command to enable the spark plugs 34 and a command to enable the fuel injectors 32 can be issued at the same time (for example, 72 degrees before the TDC in the compression stroke of the current engine cycle). Because it takes more time to enable the fuel injectors 32 than the spark plugs 34, the spark plugs 34 will be enabled before the fuel injectors 32 are enabled.

While the scheduling module 42 has been described in connection with a variable displacement module for a variable displacement engine, the scheduling module 42 may have other applications. For example, the scheduling module 42 may be incorporated in systems or modules, including but not limited to, a deceleration fuel cut-off (DFCO) control module, a traction control module, a stability control module, an engine over-speed control module, and a vehicle speed control module. For example, in various control implementations, one or more cylinders are deactivated for purposes other than improving fuel economy. For example, the variable displacement module 44 may be replaced with a DFCO control module, a transition control module, a stability control module, an engine over-speed control module, a vehicle speed control module, or any other control module that initiates cylinder deactivation under selected conditions.

Figure 5:
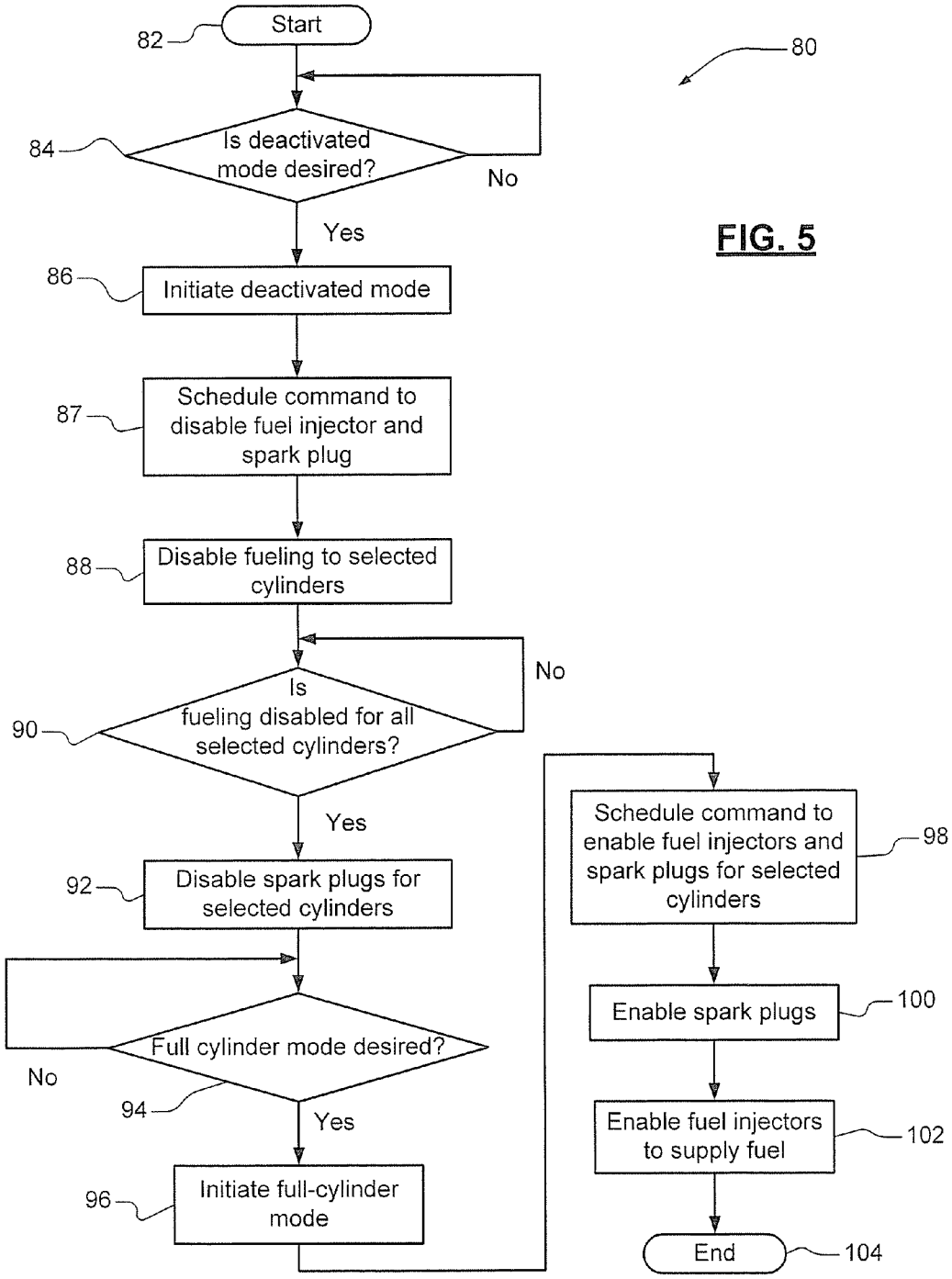
FIG. 5 is a flow diagram of a method of transitioning an engine between a full-cylinder mode and a deactivated mode according to the present disclosure.

Referring to FIG. 5, a method 80 of transitioning an engine between a deactivated mode and a full-cylinder mode starts in step 82. The engine mode transition module 50 determines whether a deactivated mode is desired in step 84. If true, the engine mode transition module 50 initiates a deactivated mode and sends a deactivation command to the scheduling module in step 86. The scheduling module 42 schedules the command to disable the fuel injector and the spark plug in step 87. The scheduling module 42 commands the fuel injection control module 46 to disable fueling to selected cylinders in step 88.

In step 90, the fuel injection control module 46 determines whether fueling is disabled for all selected cylinders. If true, the spark control module 48 disables the spark plugs 34 in step 92. If false, the method 80 returns to step 88 to stop fueling to the selected cylinders.

The engine mode transition module 50 continues to monitor the engine operating conditions and determines whether a full-cylinder mode is desired in step 94. If true, the engine mode transition module 50 initiates a full-cylinder mode and issues an activation command to the scheduling module 42 in step 96. The scheduling module 42 schedules the command to enable the fuel injectors 32 relative to the command to enable the spark plugs 34 in step 98. The spark plugs 34 are enabled in step 100. The fuel injectors 32 are scheduled to be enabled at least two engine cycles after the command to enable the spark plugs 34 in step 102. The method 80 ends in step 104.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A control system comprising:

an engine mode transition module that initiates a deactivated mode to deactivate at least one cylinder; and a scheduling module that schedules a first command to disable a spark plug of the at least one cylinder at least one engine cycle after a second command to disable a fuel injector of the at least one cylinder.

2. The control system of claim 1 wherein the scheduling module schedules the first command to disable the spark plug at least two engine cycles after the second command to disable the fuel injector.

3. The control system of claim 2 wherein the scheduling module schedules the second command to disable the fuel injector in a current engine cycle when the engine mode transition module initiates the deactivated mode.

4. The control system of claim 3 wherein the scheduling module schedules the second command to disable the fuel injector before a top dead center in a compression stroke of the current engine cycle.

5. The control system of claim 4 wherein the scheduling module schedules the second command to disable the fuel injector at 72 degrees before the top dead center in the compression stroke of the current engine cycle.

6. The control system of claim 4 wherein the scheduling module schedules the first command to disable the spark plug at 72 degrees before a top dead center in a compression stroke of a next engine cycle immediately following the current engine cycle.

7. The control system of claim 1 wherein the scheduling module schedules a third command to enable the fuel injector of the at least one cylinder at least one engine cycle after a fourth command to enable the spark plug of the at least one cylinder when the engine mode transition module initiates a full cylinder mode.

8. The control system of claim 7 wherein the scheduling module schedules the fourth command to enable the spark plug before a top dead center in a compression stroke of a current engine cycle when the engine mode transition module initiates the full-cylinder mode.

9. The control system of claim 8 wherein the scheduling module schedules the third command to enable the fuel injector at 72 crankshaft degrees before a top dead center in a compression stroke of a next engine cycle immediately following the current engine cycle.

10. The control system of claim 1 further comprising at least one of a variable displacement module, a deceleration fuel cut off (DFCO) module, a traction control module, a stability control module, an engine over-speed control module, and a vehicle speed control module, wherein the at least one of the variable displacement module, the DFCO module, the traction control module, the stability control module, the engine over-speed control module, and the vehicle speed control module communicates with the spark control module.

11. A method of transitioning an engine between a full cylinder mode and a deactivated mode comprising:

initiating, using an engine mode transition module, a deactivated mode to deactivate at least one cylinder;

scheduling, using a scheduling module, a first command to disable a spark plug of the at least one cylinder at least one engine cycle after a second command to disable a fuel injector of the at least one cylinder; and disabling the fuel injector and the spark plug, using a fuel injection control module and a spark control module, based on the second and first commands, respectively.

12. The method of claim 11 further comprising issuing, using the scheduling module, the second command to disable the fuel injector in a current engine cycle when the deactivated mode is initiated.

13. The method of claim 12 further comprising issuing, using the scheduling module, the second command to disable the fuel injector before a top dead center in a compression stroke of the current engine cycle.

14. The method of claim 13 further comprising issuing, using the scheduling module, the second command to disable the fuel injector at 72 degrees before the top dead center in the compression stroke of the current engine cycle.

15. The method of claim 14 further comprising issuing, using the scheduling module, the first command to disable the spark plug at least two engine cycles after the second command to disable the fuel injector is issued.

16. The method of claim 11 further comprising scheduling, using the scheduling module, a third command to enable the fuel injector of the at least one cylinder at least one engine cycle after a fourth command to enable the spark plug of the at least one cylinder is issued.

17. The method of claim 16 further comprising issuing, using the scheduling module, the fourth command to enable the spark plug at 72 degrees before a top dead center of a compression stroke of a current engine cycle when the full-cylinder mode is initiated.

18. The method of claim 16 further comprising issuing, using the scheduling module, the third command to enable the fuel injector at 72 degrees before a top dead center of a compression stroke of a next engine cycle immediately following the current engine cycle when the full-cylinder mode is initiated.

* * * * *